United States Patent [19]

Smith et al.

[11] 4,189,080

[45] * Feb. 19, 1980

[54] IMPACT DEVICE

[75] Inventors: James E. Smith, Boulder, Colo.; Carl T. Becht, Cincinnati, Ohio

[73] Assignee: Senco Products, Inc., Cincinnati, Ohio

[ * ] Notice: The portion of the term of this patent subsequent to Oct. 24, 1995, has been disclaimed.

[21] Appl. No.: 880,448

[22] Filed: Feb. 23, 1978

[51] Int. Cl.[2] ..... B25C 1/06

[52] U.S. Cl. ..... 227/8; 227/131

[58] Field of Search ..... 227/8, 131; 173/13, 173/117, 53, 124

[56] References Cited

U.S. PATENT DOCUMENTS

| | | | |
|---|---|---|---|
| 3,519,186 | 7/1970 | Volkmann | 227/8 |
| 3,677,457 | 7/1972 | Ramspeck et al. | 227/8 |
| 3,713,573 | 1/1973 | Fehrs | 227/8 |
| 3,924,789 | 12/1975 | Avery et al. | 227/131 |
| 4,042,036 | 8/1977 | Smith et al. | 227/131 |
| 4,121,745 | 10/1978 | Smith et al. | 227/131 |
| 4,129,240 | 12/1978 | Geist | 227/131 |

*Primary Examiner*—John McQuade

*Attorney, Agent, or Firm*—Melville, Strasser, Foster, Frost & Jacobs

[57] ABSTRACT

An impact device, useful for driving nails, staples and other fastening elements. The driving member is driven by frictional engagement with a rotating high speed flywheel. The device has a safety provision whereby it cannot be actuated until the nose of the device is pressed against a work piece. This action also produces a movement of a support means, such as a roller, towards the rotating flywheel. It should be pointed out that the tool could be designed, in the alternative, with a fixed support means and movable flywheel. Actuation of the trigger moves the driving member into engagement between the support and the rotating flywheel, and the flywheel propels the driving element in a fastener driving direction. The support means is provided with a leaf spring permitting it to yield so that the driving member can pass between the flywheel and the support means while maintaining frictional engagement between the flywheel and the driving member. Inertia of the support means aids in efficient engagement of the flywheel with the driving member. The driver is connected to an elastic member, so that when the tool is lifted from the work, the movable support means is moved away from the fixed flywheel, and the elastic member then retracts the driving member between the flywheel and the support means to a position out of contact therewith. The flywheel can be driven by any of several drive means including compressed air, internal combustion and electric drive means. The preferred embodiment is powered by a single electric motor.

26 Claims, 9 Drawing Figures

IMPACT DEVICE

CROSS REFERENCE TO RELATED APPLICATION

This application discloses and claims improvements over the disclosures of U.S. Pat. No. 4,042,036 in the names of James E. Smith et al., and Ser. No. 810,903 filed June 28, 1977 in the names of James E. Smith and Carl T. Becht, now U.S. Pat. No. 4,121,745 dated Oct. 24, 1978.

BRIEF SUMMARY OF THE INVENTION

Powered nailers and staplers have come into widespread use by virtue of the fact that they are capable of more rapidly and more precisely driving fasteners than can be accomplished by manual fastener driving. Such power devices have been largely pneumatic; but this has necessitated the presence of a source of compressed air, and long, relatively heavy hoses. On a construction job, it was necessary to have a portable air compressor; and for work on the roof of a house, or an upper story, the air hoses had to be quite long, because the compressor usually remained on the ground.

It is therefore desirable to provide a non-pneumatic powered nailer or stapler, which will require a source of energy other than compressed air. Electricity, for example, is always present at a construction site so as to permit the use of electric drills, electric power saws, and the like. An electrically powered tool would also be desirable for use in the home, where compressed air is usually not available but electricity is.

U.S. Pat. No. 4,042,036 discloses an electrically powered device which can drive a sixteen penny nail into semi-hard wood, but the tool is subject to a number of limitations. These limitations are overcome by the device disclosed in Ser. No. 810,903. That device, however, like the device of U.S. Pat. No. 4,042,036, requires that two flywheels be synchronously counterrotated at high speeds. While the various means for accomplishing high speed snychronous counterrotation described in Ser. No. 810,903 will produce the desired result, these means tend to increase the weight and noise level of the device, as well as adding mechanical complexity.

The tool according to the present invention overcomes the objections mentioned above. It employs a single rotating flywheel and a support means, such as a roller, for supporting the side of the driver element opposite the flywheel. While the tool will work equally well with a fixed flywheel and movable support, or a movable flywheel ad fixed support, for mechanical simplicity, in the tool according to the present invention, the flywheel is fixed and the support is movable and normally biased away from the fixed flywheel. For actuation the movable support is caused to approach the fixed flywheel, so that the space between the flywheel and the movable support is narrower than the thickness of the driver element. The drive is then achieved by introducing the driver element between the rotating flywheel and the movable support. The inertia of the movable support assembly opposes separation upon introduction of the driver element, and therefore assists in efficient engagement of the flywheel and driver element. A leaf spring permits the movable support assembly to yield a small amount to accommodate the driver element between the flywheel and the movable support, while maintaining frictional drive between the flywheel and the driver element.

A safety is provided, which, upon contacting the work piece, moves the movable support assembly from inoperative to operative position, and frees the trigger for manual actuation. When the tool is removed from contact with the work, the movable support assembly returns to its inoperative position. The drive element is maintained out of contact with the flywheel by an elastic member, and is moved into contact with the flywheel by actuation of the trigger.

It should be pointed out that the inertia opposing separation of the flywheel and movable support assembly upon introduction of the driver element between them causes very large normal forces to be exerted on the driver element so that, even with low friction coefficients, large drive forces are possible. The use of inertia to assist clutch engagement rather than impede clutch engagement as is the case of the tool built according to the teachings of U.S. Pat. No. 4,042,036, results in higher clutch efficiency.

The driving force in the tool according to the present invention is provided by a single rotating flywheel. The flywheel can be driven by any of several drive means including electric drive, internal combustion and compressed air. The preferred embodiment of the present invention is designed to be powered by a single electric motor.

The single rotating flywheel creates a gyroscopic effect which, depending on the physical specifics of the particular tool used, could make rapid movement of the tool difficut. This gyroscopic effect can be easily countered by arranging to drive the flywheel in the opposite direction from that of the electric motor. In this way, the gyroscopic effect of the motor rotor is used to oppose that of the flywheel. Alternatively, a light high speed idler could be driven in the opposite direction from that of the flywheel to perform the same function.

BRIEF DESCRIPTION OF THE SEVERAL FIGURES OF THE DRAWING

FIG. 8 is an enlarged fragmentary cross sectional view showing the driver element, the rotating flywheel and the support roller just prior to engaging the driver element.

DETAILED DESCRIPTION

Figures 1, 2, 6, 7:
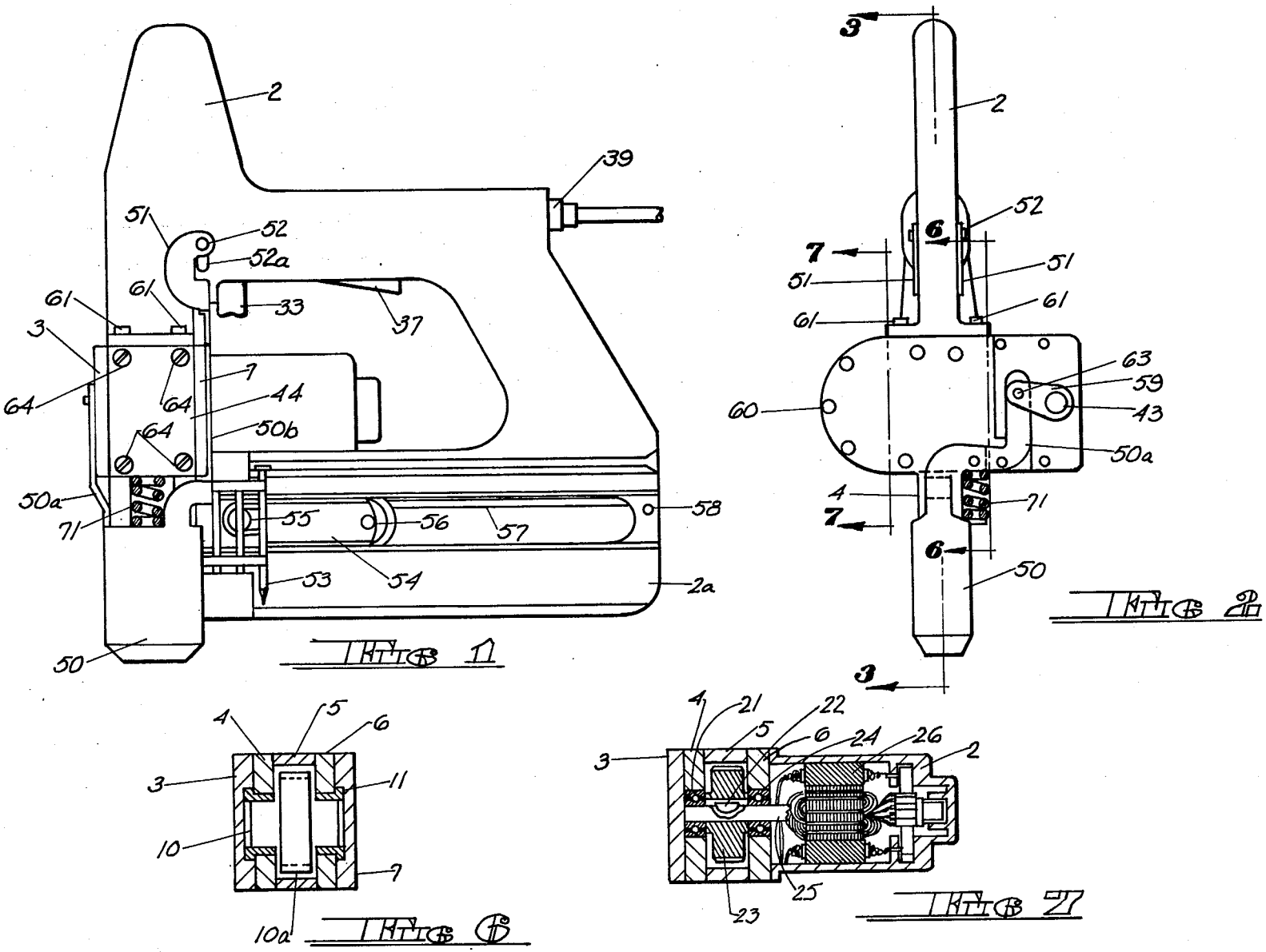
FIG. 1 is a side elevational view of a tool according to the present invention.
FIG. 2 is a front elevational view thereof as seen from the left of FIG. 1.
FIG. 6 is a fragmentary cross sectional view taken on the line 6—6 of FIG. 2.
FIG. 7 is a fragmentary cross sectional view taken on the line 7—7 of FIG. 2.

The device of the present invention will be described as an electromechanical device for driving nails. It should be understood, however, that it may be utilized for driving any other type of fastening elements or for any purpose requiring high velocity impact.

The main housing of the tool is designated at 2 and it includes a section serving for a nail magazine designated at 2a. The flywheel housing is indicated at 5 (best seen in FIGS. 5, 6 and 7) and it is disposed between the bearing support plates 4 and 6. These bearing support plates also provide guide means for the driver element 27 (see FIGS. 3A, 5 and 8). The housing 5 and the bearing plates 4 and 6 are fastened together by means of screws 60, and the flywheel housing and main housing are secured together by screws 61.

The support means 10a is shown in the preferred embodiment as a low inertia roller equal in diameter to the rotating flywheel. Other support means, such as a linear bearing or a Teflon block, could be used to accomplish the same purpose.

The flywheel and support roller, as best seen in FIG. 8, are indicated at 23 and 10a. The tool according to the present invention is described as having a fixed flywheel and movable support for mechanical simplicity. It should be pointed out, however, that the tool will work equally well with a fixed support and movable flywheel. The flywheel 23 is keyed to the rotor shaft 25 at 22 while the stator 26 of the motor and other components of the motor are mounted in the main housing 2 as best seen in FIG. 7. The rotor shaft 25 is supported in the bearing plate 6 by means of the bearing 24 and in the bearing plate 4 by means of the bearing 21.

The support roller 10a is mounted on and turns on axle 10 which is retained within bearing clevis 11.

Figure 5:
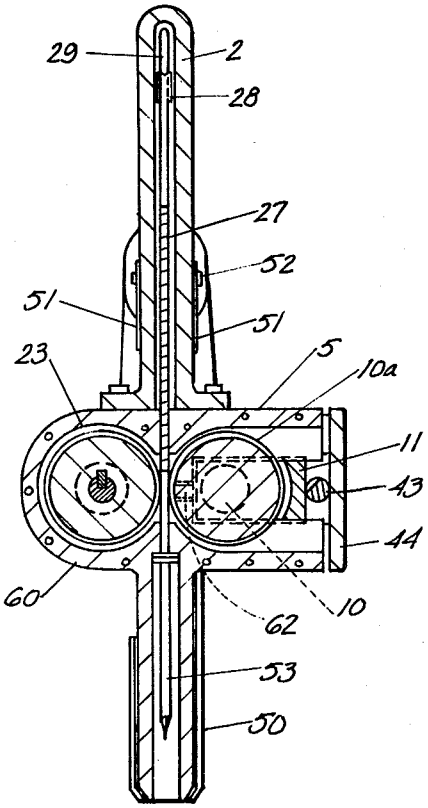
FIG. 5 is a cross sectional view taken on the line 5—5 of FIG. 3.
Figure 4:
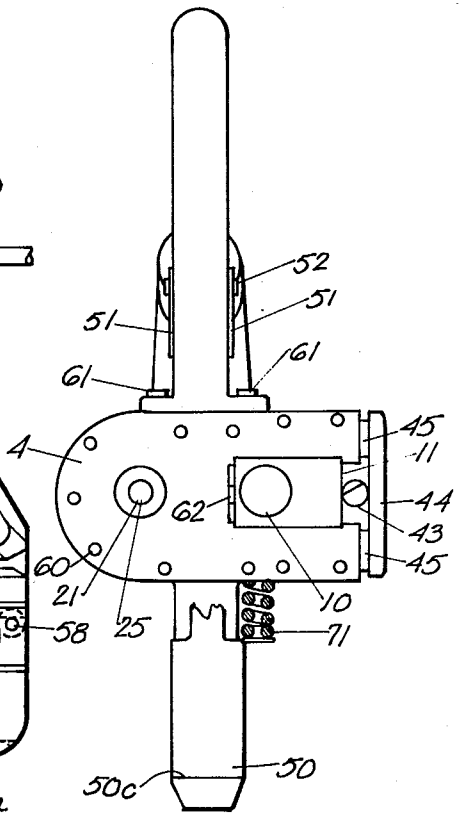
FIG. 4 is a front elevational view of FIG. 3 with the cover housing 3 removed.
Figure 3:
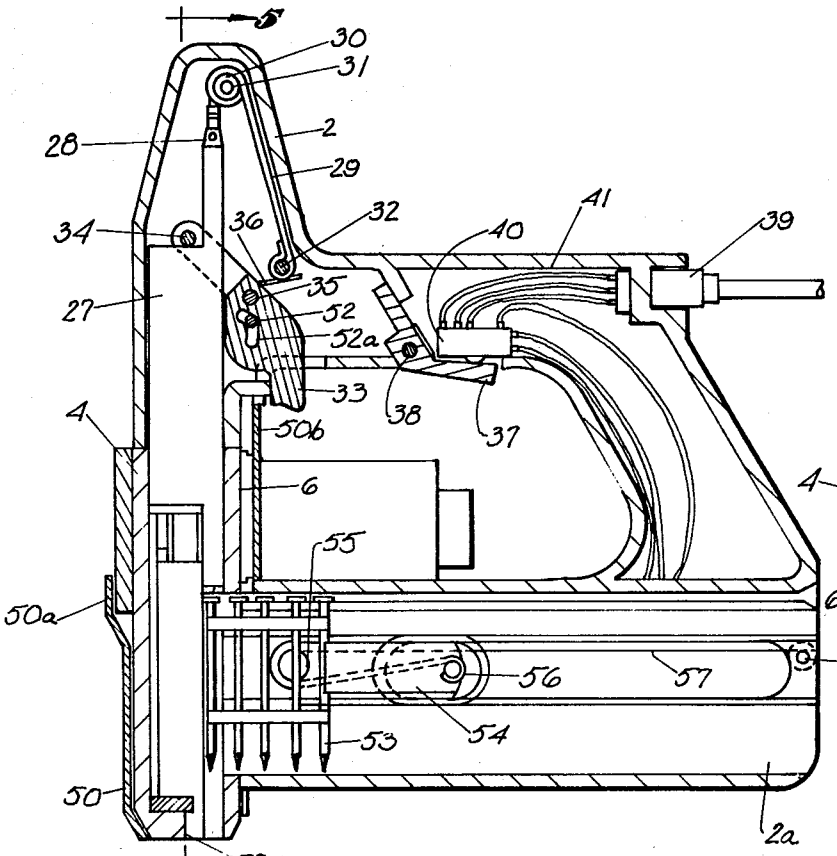
FIG. 3 is a cross sectional view taken on the line 3—3 of FIG. 2.
Figure 3B:
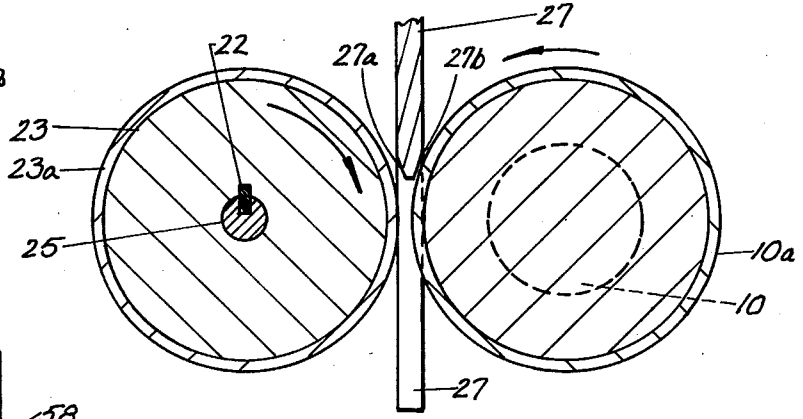
FIG. 3A is a view similar to FIG. 1 showing the tool in the position out of contact with the work and the safety in position to prevent actuation of the trigger.
Figure 3A:
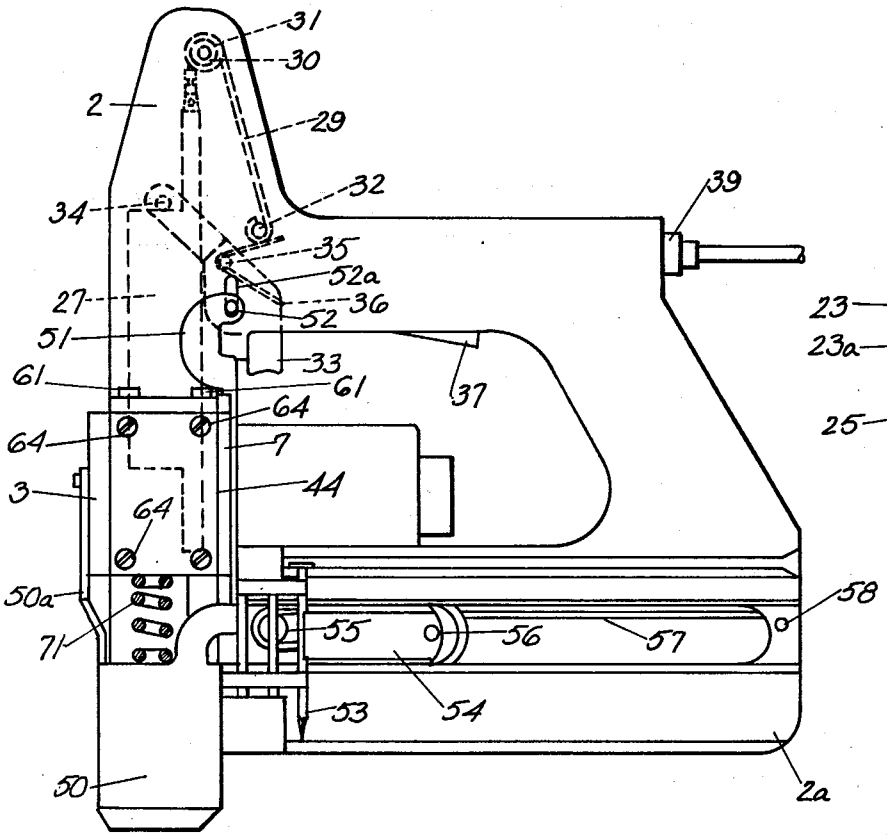

The bearing clevis 11 which carries the axle 10 and support roller 10a is perhaps best seen in FIGS. 4, 5 and 6. The clevis 11 is constantly biased away from the flywheel 23 by means of springs 62 (FIG. 5). A spring plate 44 is attached to the bearing plates 4 and 6 by means of screws 64 (FIGS. 1 and 3A).

The mounting of the axle 10 in the clevis 11 makes it possible to cause the axle 10 with mounted support roller 10a to approach and move away from the flywheel 23. As indicated above, the springs 62 continuously bias the clevis and therefore the axle 10 and support roller 10a away from the flywheel 23. A cam rod 43 is mounted in the cover housing 3 and the cover plate 7 so as to abut the spring plate 44 and the end surface of the bearing clevis 11. The cam rod, as clearly seen in FIGS. 4 and 5, has a flat so that when the flat is turned toward the bearing clevis 11, the bearing clevis is permitted to move slightly toward the right. When the rod 43 is turned to the position of FIGS. 4 and 5, the bearing clevis is moved toward the left to bring the axle 10 and support roller 10a closer to the flywheel 23. The spacing is such that in the position of FIG. 5 the peripheries of the flywheel 23 and support roller 10a are spaced apart a distance slightly less than the thickness of the driver element 27. The spring plate 44 permits the support roller 10a to move slightly away from the flywheel 23 to accommodate the thickness of the driver element 27 and yet maintain pressure on the driver element. The spring plate, as best seen in FIGS. 3A, 4 and 5, is mounted to the bearing plates 4 and 6 by means of screws 64 and with the spacers 45.

One end of the cam rod 43 is mounted in the cover housing 3 and is equipped with a lever 59 (FIG. 2). This lever is operatively connected to the safety element 50 which operates by contact with the work piece. The lever 59 is secured to the safety 50 by means of the pin 63. The safety 50 has the portion 50a (FIG. 2) at the front of the tool and the portion 50b (FIG. 1) extending up inside the handle portion of the tool. The portion 50b is secured to the ears 51 for a purpose which will be described hereinafter.

From the foregoing description, it will be clear that when the tool is pressed against the work (FIGS. 1 and 3) the lever 59 will be rotated clockwise (FIG. 2) to bring cam rod 43 to the position shown in FIGS. 4 and 5 in which the support roller 10a is brought into operative position. When the tool is lifted from the work piece, the safety element 50 returns, as a result of spring 71, to the position in FIG. 3A in which the lever 59 rotates the cam rod to a position in which the flat abuts the bearing clevis 11, thereby permitting the support assembly including the support roller 10a to move back into inoperative position.

The driver element or impact ram 27 is mounted in and guided between the bearing plates 4 and 6. At its upper end it is connected by means of a clevis 28 to an elastomeric means 29. The member 29 is guided over a pulley 30 mounted on the pin 31 and secured by a pin 32 at its remote end. This structure maintains the driver element or impact ram in its uppermost position (FIG. 3 and FIG. 8). It should be pointed out that, while elastomeric means 29 is utilized in the preferred embodiment of this invention, other drive element returns and retention means are recognized, and could be used without departing from the spirit of the invention. A manual trigger is provided at 33 which is mounted by means of a pin 35 and pivots about the pin 35. The trigger is biased to inoperative position by a torsion spring 36. A pin 34 running through the clevis end of the manual trigger 33 rests upon the ram or driver element 27. As seen in FIG. 8, in the at rest position the member 27 is out of contact with the flywheel 23 and support roller 10a and when the trigger is actuated, the rocking of the trigger transmits the action by means of the pin 34 to start the ram 27 downward to the point where it is engaged between the flywheel 23 and support roller 10a.

Slots 52a are provided in the main housing 2 and a safety pin 52 passes through the trigger 33 and through the slots 52a. On the outside of the housing 2 the safety pin 52 is connected to the safety clevis 51 mentioned above. This straddles the main housing 2 and is connected to the work piece responsive safety 50 by portion 50b. From a consideration of FIGS. 3 and 3A, it will be observed that in the idle position with the tool out of contact with the work piece the trigger cannot be pivoted about the point 35 because the pin 52 is confined in the lower portion of slot 52a and also in the lower portion of the corresponding slot in trigger 33. However at the top of the slot in trigger 33 there is an offset best seen in FIG. 3, so that when the safety 50 is pressed against the work, the pin 52 is moved to the top of the slot 52a and the top of the corresponding trigger slot and the small offset permits the trigger to be actuated and thus start the impact element 27 on its downward path.

Flywheel 23 can be driven by any of several drive means including electric drive, internal combustion and compressed air. The preferred embodiment of the tool according to the present invention is powered by a single electric motor as best seen in FIG. 7.

Electrical energy is provided by means of an extension cord 39. This is connected to a suitable switch 40 by means of the wires 41. The switch 40 is normally off so as to prevent flow of current to the motor. Adjacent to the switch 40 the housing 2 is provided with a "dead man" trigger 37 mounted on a pin 38. Thus, when the device is held in the hand as it normally would be gripped, the dead man trigger 37 will actuate the switch 40 and provide electrical energy for the motor. As soon as the device is released, however, the dead man trigger 37 returns to its normal position and de-activates the switch 40.

As indicated heretofore, the lower portion of the main housing indicated at 2*a* is adapted to hold a strip of nails 53. The strip of nails is urged into position to be driven by means of a feeder 54 which is urged forward by the elastomeric member 57. The member 57 is connected to the pin 56 in the feeder 54 and then passes around the roller 55 and is attached to the pin 58 at the rear of the magazine portion 2*a*.

In operating the device, the extension cord 39 is plugged into the rear of the handle portion of the main housing 2. With the device in this condition, all the components would appear as they do in FIG. 3*a*. In this condition the trigger 33 cannot be actuated even if the dead man trigger 37 is actuated. The bearing clevis 11 with its axle 10 and support roller 10*a* will be at the point farthest away from the flywheel 23 or in its inoperative condition. It will be assumed that a strip of nails 53 has been placed in the magazine portion 2*a*.

When the device is gripped around the handle portion the dead man trigger 37 is depressed so that the switch 40 is activated to provide current to the motor. The rotor shaft 25 of the motor begins to turn and therefore the flywheel 23 begins to rotate. In a very short period of time, the flywheel 23 will be up to the maximum rpm developed by the motor and the device is then fully energized and ready to drive nails.

If the operator now presses the work piece responsive safety 59 against the material into which the nail is to be driven, the pin 63 causes the lever 59 to be rotated in a clockwise direction as heretofore described. This produces rotation of the cam rod 43 to the position of FIGS. 4 and 5, thereby moving the support assembly comprising the bearing clevis 11 and axle 10 with support roller 10*a* mounted thereon toward the flywheel 23. At the same time, the safety clevis 51 moves upward and carries the pin 52 with it. When the work piece responsive safety has been moved to its furthermost position, the distance between the peripheries of the flywheel 23 and support roller 10*a* will be less than the thickness of the impact ram 27 and the safety pin 52 will have been moved to a position where the manual trigger 33 may be operated as heretofore described.

When the operator squeezes the manual trigger 33 whereby it is caused to rotate about the pin 35 and against the pressure of the torsion spring 36, the pin 34 contacts the upper surface of the impact ram and moves it downward toward the flywheel 23 and support roller 10*a*, thereby also slightly extending the elastomeric member 29.

As best seen in FIG. 8, flywheel 23 may be coated with a material having a relatively high dynamic coefficient of friction as indicated at 23*a*. This coating material would preferably be a strong, dense, high modulus material such as the type which is used for aircraft brakes.

As an option, the friction lining can be applied to the impact ram 27 instead of to the flywheel 23. The lower end of that portion of member 27 which is to enter between the flywheel 23 and support roller 10*a*, may be provided with a short taper at 27*a* and 27*b*. When these tapered sides of the impact ram come into contact between the rapidly rotating flywheel 23 and support roller 10*a*, the flywheel frictionally engages the impact ram and rapidly accelerates it to the same linear speed as the peripheral speed of the flywheel. Support roller 10*a*, being a low inertia sleeve, is initially stationary but will easily turn to facilitate the movement of impact ram 27 under the influence of flywheel 23. Energy stored in the flywheel is now transferred through the impact ram 27 to the forwardmost nail in strip 53 which is driven into the material to be fastened. As the impact ram is admitted between the flywheel and support roller 10*a*, support roller 10*a* along with axle 10 and clevis 11 is forced away from fixed flywheel 23. The inertia of the assembly of clevis 11, axle 10 and support roller 10*a* acts to oppose that separation, and thereby aids in the frictional engagement of flywheel 23 with the impact ram. In addition, from the time the impact ram 27 contacts the flywheel and support roller 10*a* until it leaves them slightly before the end of the working stroke, the movable support roller 10*a* is forcibly in contact with the impact ram 27 by virtue of the spring plate 44. As the movable support roller 10*a* tries to back away from the fixed flywheel 23 to admit the impact ram, the axle 10 and bearing clevis 11 move with it, thereby causing the cam rod 43 to flex the spring plate 44. Slightly before the termination of the working stroke, the impact ram 27 passes beyond the flywheel 23 and movable support roller 10*a* and a portion of the kinetic energy of the impact ram is absorbed by continued driving of the nail. The remaining kinetic energy of the impact ram is absorbed by a ram stop device, such as a bumper 50*c* in the nose piece of the tool, which is well known in the art. The working stroke is now complete.

The operator now releases the manual trigger 33 and the work piece responsive safety 50 is returned to its original position under the influence of spring 71 as the device is lifted from the work piece. As the safety returns to its original position, the pin 63 causes the lever 59 to rotate the cam rod 43 back to its original position permitting the bearing clevis 11 and its axle 10 and support roller 10*a* to move away from the flywheel 23 under the influence of the spring 62. The space between the flywheel and support roller 10*a* is now greater than the thickness of the impact ram and therefore under the influence of the elastomeric member 29 the ram returns to its original position. The return stroke is now complete and the cycle may once again be initiated.

While the tool has been described in considerable detail, it will be clear that numerous modifications may be made without departing from the spirit of the invention and no limitation which is not specifically set forth in the claims is intended and no such limitation should be implied.

The embodiments of the invention in which an exclusive property or privilege is claimed are defined as follows:

1. An impact tool comprising:

(a) an impact member;

(b) a rotatable flywheel and means to drive the same, and support means spaced apart by less than the thickness of the impact member;

(c) means for introducing the impact member between said flywheel and said support means; and (d) means permitting at least one of said flywheel and support means to yield with respect to the other to permit the impact member to pass therebetween, while maintaining force against the impact member.

2. An impact tool according to claim 1, wherein means are provided to move selectively at least one of said flywheel and support means from inoperative position in which spacing therebetween is greater than the thickness of the impact member, to an operative position in which said spacing is less than the thickness of said impact member.

3. An impact tool according to claim 2, wherein said support means is a low inertia roller.

4. An impact tool according to claim 3, wherein a line connecting the axes of rotation of said flywheel and said roller in the operative position of the movable one of said flywheel and roller is at right angles to the path of said impact member.

5. An impact tool according to claim 4, wherein the movable one of said flywheel and roller, in moving between its operative and inoperative positions, moves substantially along a line connecting the said axes.

6. An impact tool according to claim 2, including a work responsive device, said work responsive device when actuated by contact with the work, operating to move the movable one of said flywheel and support means to its operative position.

7. An impact tool according to claim 6, wherein a manually actuated control means comprises a trigger for bringing said impact member into contact between said flywheel and support means, and said work responsive device prevents movement of said impact member by said trigger unless said work responsive device is pressed against the work.

8. An impact tool according to claim 2, including means for introducing said impact member between said flywheel and support means only after the movable one of said flywheel and support means is in operative position.

9. An impact tool according to claim 8, including means, operative upon the movement of the movable one of said flywheel and support means to its inoperative position, to withdraw the impact member between said flywheel and support means.

10. An impact device according to claim 8, including a trigger for bringing said impact member into contact between said flywheel and support means, and including a work responsive device preventing movement of said impact member by said trigger unless said work responsive device is pressed against the work piece.

11. An impact tool according to claim 1, wherein said impact member, flywheel and support means are contained within a housing, said housing defining a drive path for said impact member.

12. An impact tool according to claim 1, wherein a portion of said impact member is tapered to facilitate its entry between said flywheel and support means.

13. An impact tool according to claim 1, having a motor for driving said flywheel and including a "dead man" switch, said switch being open when said tool is not being grasped by an operator but being closed when the device is grasped by an operator for use, said motor being energized only when said switch is closed.

14. An impact tool according to claim 1, having a magazine section for fastening elements, and means for feeding said elements into position to be driven into a work piece by said impact member.

15. An impact tool according to claim 1, wherein one of said flywheel and support means is mounted on a movable bearing clevis, the means permitting the movable one of said flywheel and support means to yield with respect to the other to permit the impact member to pass therebetween comprises means permitting said bearing clevis to move with respect to the other of said flywheel and support means, while maintaining force against the impact member.

16. An impact tool according to claim 15, wherein the means permitting said bearng clevis to move with respect to the other of said flywheel and support means to permit the impact member to pass therebetween includes cam means and a spring plate arranged to bear against said cam means, such that when said cam means have moved said bearing clevis to operative position, wherein the spacing between said flywheel and support means is less than the thickness of said impact member, and the entry of said impact member therebetween causes said bearing clevis to move slightly, this movement is permitted by said spring plate, and said spring plate maintains pressure against said bearing clevis during the passage of the impact member therebetween.

17. An impact tool comprising a main housing, a flywheel housing in which a flywheel and support means are mounted, a motor having a shaft and mounted on said main housing, said flywheel being keyed on said motor shaft, a bearing clevis in said main housing movable between an operative and inoperative position, said support means being mounted on said bearing clevis, spring means biasing said bearing clevis to the inoperative position, cam means to move said bearing clevis to operative position, an impact member elastically supported in said main housing out of engagement with said flywheel and support means, the spacing between said flywheel and support means in the inoperative position being greater than the thickness of said impact member, and the spacing in the operative position being less than the thickness of said impact member, means to bring the impact member into contact between said flywheel and support means when the bearing clevis is in the operative position, means permitting said bearing clevis to yield to permit the impact member to enter therebetween while maintaining pressure against said impact member, the elastic support of said impact member serving to withdraw it from between said flywheel and support means when said bearing clevis is returned to inoperative position.

18. An impact tool according to claim 17, wherein said support means is a low inertia roller.

19. An impact tool according to claim 18, wherein a line connecting the axes of rotation of said flywheel and said roller in the operative position of said roller is at right angles to the path of said impact member.

20. An impact tool according to claim 19, wherein the roller, in moving between its operative and inoperative positions, moves substantially along a line connecting the said axes.

21. The impact tool of claim 17, wherein a work responsive device is provided, said work responsive device when actuated by contact with the work, operating said cam means to move said support means to its operative position.

22. The impact tool of claim 21, wherein a trigger is provided to bring said impact member into contact between said flywheel and support means, and means associated with said work responsive device preventing movement of said impact member by said trigger unless said work responsive device is pressed against the work.

23. The impact tool of claim 17, wherein a portion of said impact member is tapered to facilitate its entry between said flywheel and support means.

24. The impact tool of claim 17, wherein a "dead man" switch is provided, said switch being open when said impact tool is not being grasped by an operator but being closed when said impact tool is grasped by an operator for use, said motor being energized only when said switch is closed.

25. The impact tool of claim 17, having a magazine section for fastening elements, and means for feeding said elements into position to be driven into a work piece by said impact member.

26. The impact tool of claim 17, wherein the means permitting said bearing clevis to yield comprises a spring plate arranged to bear against said cam means, such that when said cam means has moved said bearing clevis to operative position wherein the spacing between said flywheel and the support means is less than the thickness of said impact member and the entry of the impact member therebetween causes said bearing clevis to move slightly, this movement is permitted by said spring plate, and said spring plate maintains pressure against said bearing clevis during the passage of the impact member therebetween.

* * * * *